US009390653B2

(12) United States Patent
Lin

(10) Patent No.: US 9,390,653 B2
(45) Date of Patent: Jul. 12, 2016

(54) PIXEL CIRCUIT WITH ORGANIC LIGHT EMITTING DIODE

(71) Applicant: AU Optronics Corporation, Hsin-Chu (TW)

(72) Inventor: Yu-Kai Lin, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 93 days.

(21) Appl. No.: 14/572,909

(22) Filed: Dec. 17, 2014

(65) Prior Publication Data

US 2016/0063920 A1 Mar. 3, 2016

(30) Foreign Application Priority Data

Aug. 29, 2014 (TW) ..... 103129950

(51) Int. Cl.
*G09G 3/30* (2006.01)
*G09G 3/32* (2016.01)

(52) U.S. Cl.
CPC ..... *G09G 3/3241* (2013.01); *G09G 2300/0426* (2013.01); *G09G 2310/08* (2013.01); *G09G 2320/0233* (2013.01)

(58) Field of Classification Search
CPC ..... G09G 3/3233; G09G 2300/0861; G09G 2300/0866; G09G 2320/0233; G09G 3/3258; G09G 2300/043; G09G 3/3208; G09G 3/3225; G09G 3/3283; G09G 3/30; G09G 2310/0264; G09G 2320/064
USPC ..... 345/76–84
See application file for complete search history.

(56) References Cited

U.S. PATENT DOCUMENTS 8,446,344 B2 * 5/2013 Choi ..... G09G 3/3233 345/76
8,902,208 B2 * 12/2014 Chung ..... G09G 3/3233 345/211
9,099,417 B2 8/2015 Yin et al.

FOREIGN PATENT DOCUMENTS

CN 103310732 A 9/2013

OTHER PUBLICATIONS

Office Action issued in corresponding China patent application on Apr. 5, 2016.

* cited by examiner

*Primary Examiner* — Duc Dinh
(74) *Attorney, Agent, or Firm* — McClure, Qualey & Rodack, LLP

(57) ABSTRACT

A pixel circuit with an organic light emitting diode (OLED) includes an OLED, a driving switch, an enabling switch, a compensation circuit, and a data switch. Through the compensation circuit, the data switch, and the control of a compensation voltage, a voltage at the control terminal of the driving switch of the pixel circuit is set according to a data voltage and the absolute value of a threshold voltage of the driving switch. Hence, the driving current determined by the driving switch relates to the data voltage.

17 Claims, 3 Drawing Sheets

1000

PIXEL CIRCUIT WITH ORGANIC LIGHT EMITTING DIODE

CROSS-REFERENCE TO RELATED APPLICATIONS

This non-provisional application claims priority under 35 U.S.C. §119(a) on Patent Application No(s). 103129950 filed in Taiwan, R.O.C. on Aug. 29, 2014, the entire contents of which are hereby incorporated by reference.

TECHNICAL FIELD

The disclosure relates to a pixel circuit, more particularly to a pixel circuit with an organic light emitting diode (OLED), which is capable of compensating threshold voltages.

BACKGROUND

Organic light emitting diodes (OLED) have a smaller size and a high luminous efficiency and can be applied to flexible panels such that they can be backlight components or pixels in a display device. The OLEDs as pixels in the display device generally use the thin-film transistor (TFT) fabrication. Transistor switches made by the TFT fabrication have a greater difference in threshold voltage ($V_{th}$) therebetween than transistor switches made by general fabrications. Moreover, the threshold voltages of the transistor switches made by the TFT fabrication will changed with the usage time. In other words, even if two TFT switches have the same threshold voltage during the manufacture, the threshold voltages of the two TFT switches will change with the usage time variously, resulting in the difference in threshold voltage between the two TFT switches.

Because the threshold voltages of the transistors in the pixel circuit of two adjacent or close pixels in the display device become different, even when the driving chip in the display device supplies the same data voltage to the two pixels to make them show the same color in an image frame, the colors shown by the two pixels become different from each other. For example, the intensity of red light emitted by the left pixel is greater than the intensity of red light emitted by the right pixel. Furthermore, when the display device has been used for a period of time, colors of the image frame displayed by the display device would be aberrant because of the change of the threshold voltages of the transistors in the OLED. Therefore, the change of threshold voltage causes such unwanted effect to the display device.

SUMMARY

According to one or more embodiments, the disclosure provides a pixel circuit. In one embodiment, the pixel circuit includes an organic light emitting diode (OLED), a driving switch, an enabling switch, a compensation circuit, and a data switch. The OLED has a first terminal and a second terminal. The first terminal of the OLED receives a first reference voltage, and the OLED is driven by a driving current. The driving switch has a first terminal, a second terminal, and a control terminal. The first terminal of the driving switch receives a second reference voltage. The driving switch controls the driving current according to a voltage at its control terminal. The enabling switch has a first terminal and a second terminal. The first terminal of the enabling switch is electrically connected to the second terminal of the driving switch, and the second terminal of the enabling switch is electrically connected to the second terminal of the OLED. The enabling switch is turned off during a first time period in a duty cycle and is turned on during a second time period in the duty cycle. The compensation circuit has a first terminal, a second terminal, a third terminal, a fourth terminal, and a fifth terminal. The first terminal of the compensation circuit receives the second reference voltage, the second terminal of the compensation circuit is electrically connected to the second terminal of the driving switch, the third terminal of the compensation circuit is electrically connected to the control terminal of the driving switch, and the fourth terminal of the compensation circuit receives a compensation voltage. The data switch has a first terminal and a second terminal. The first terminal of the data switch is electrically connected to the fifth terminal of the compensation circuit, and the second terminal of the data switch receives a data voltage. The data switch is turned on during a fourth time period in the duty cycle. The compensation voltage is at a first voltage level during the fourth time period in the duty cycle and is at a second voltage level during the duty cycle except the fourth time period. The third time period partially overlaps the fourth time period, the third time period starts in the fourth time period, and the third time period and the fourth time period are in the first time period.

In the disclosure, the pixel circuit with an OLED, through the compensation circuit, the data switch, and the control of the compensation voltage, can set the voltage at the control terminal of the driving switch to equal the data voltage minus the absolute value of the threshold voltage of the driving switch. Therefore, the driving current that is set according to the voltage at the control terminal of the driving switch is related to the data voltage rather than the threshold voltage.

BRIEF DESCRIPTION OF THE DRAWINGS

The present disclosure will become more fully understood from the detailed description given herein below for illustration only and thus does not limit the present disclosure, wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
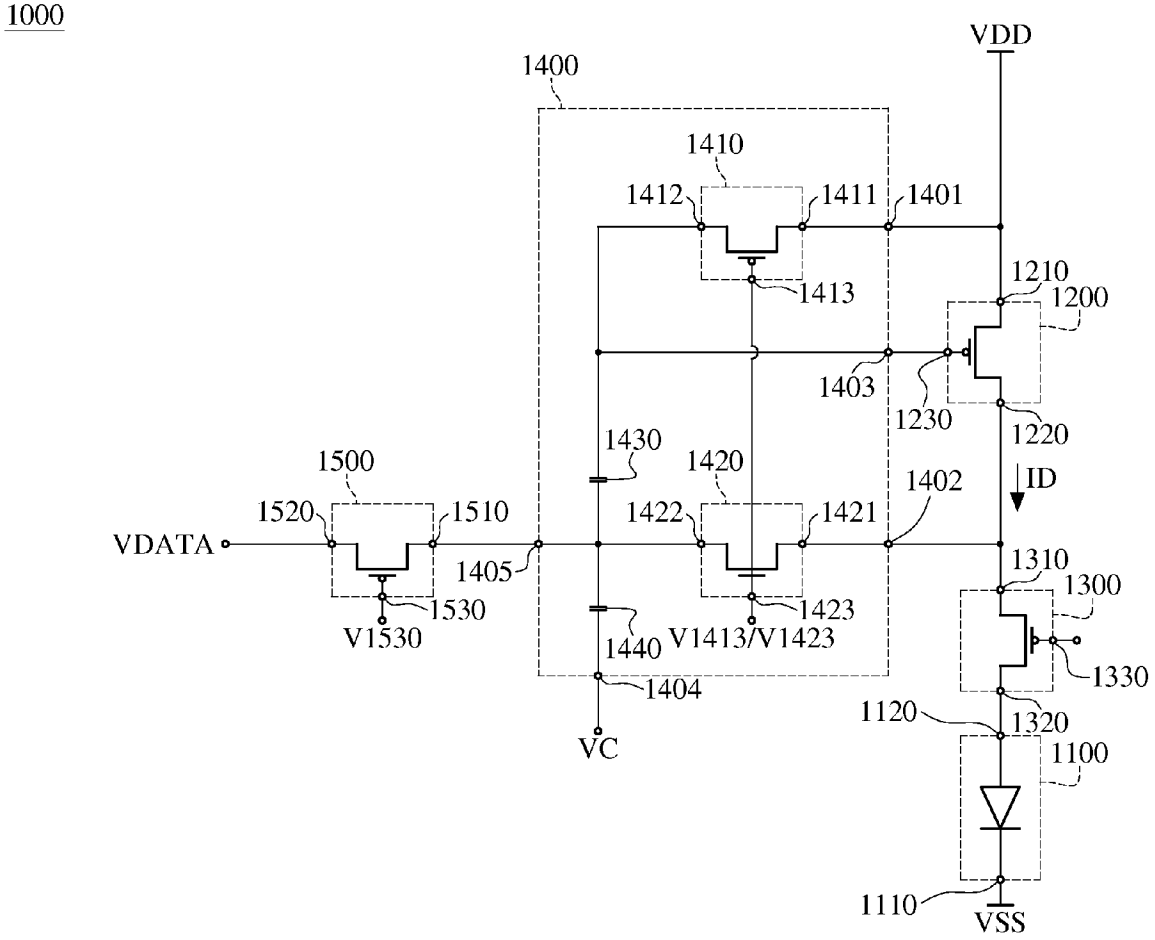
FIG. 1 is a schematic diagram of a pixel circuit with an organic light emitting diode in an embodiment of the disclosure.
Figure 2:
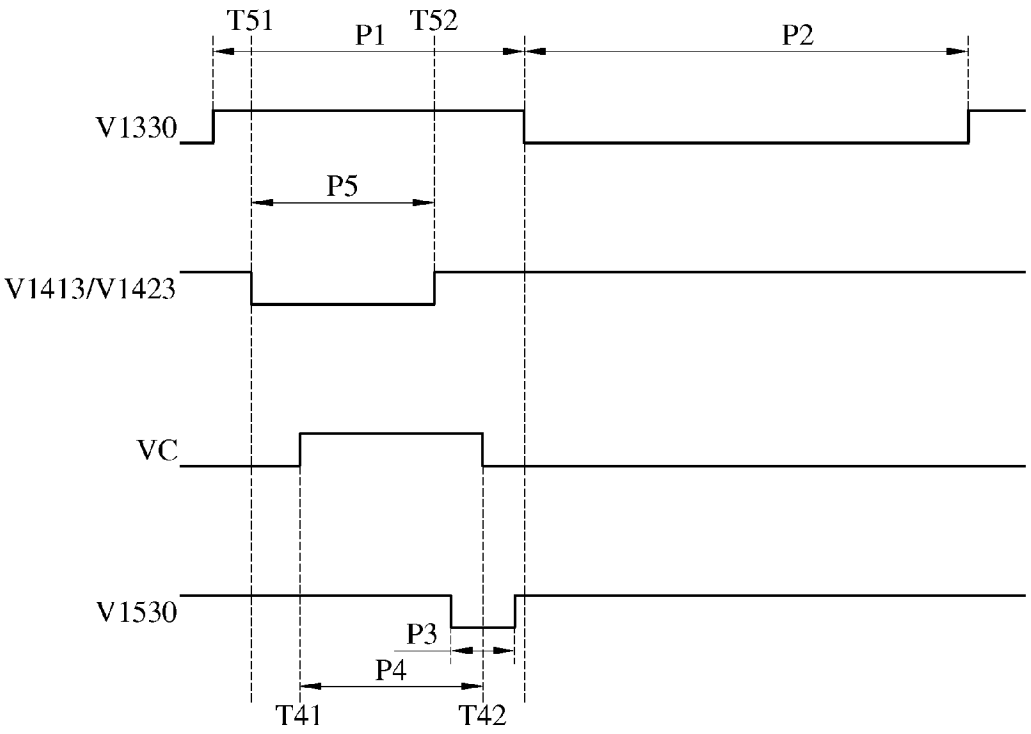
FIG. 2 is a time sequence diagram of node voltages in the pixel circuit in FIG. 1 according to an embodiment of the disclosure.

An embodiment of a pixel circuit is shown in FIG. 1 and FIG. 2. FIG. 1 is a schematic diagram of a pixel circuit with an organic light emitting diode in an embodiment of the disclosure, and FIG. 2 is a time sequence diagram of node voltages in the pixel circuit in FIG. 1 according to an embodiment of the disclosure. The pixel circuit 1000 includes an organic light emitting diode (OLED) 1100, a driving switch 1200, an enabling switch 1300, a compensation circuit 1400, and a data switch 1500. The first terminal 1110 of the OLED 1100 receives a first reference voltage VSS, and the first terminal 1210 of the driving switch 1200 receives a second reference voltage VDD. The first terminal 1310 of the enabling switch 1300 is electrically connected to the second terminal 1220 of the driving switch 1200, and the second terminal 1320 of the enabling switch 1300 is electrically connected to the second terminal 1120 of the OLED 1100. The first terminal 1401 of the compensation circuit 1400 receives the second reference voltage VDD, the second terminal 1402 of the compensation circuit 1400 electrically connects to the second terminal 1210 of the driving switch 1200, the third terminal 1403 of the compensation circuit 1400 electrically connects to the control terminal 1230 of the driving switch 1200, and the fourth terminal 1404 of the compensation circuit 1400 receives a compensation voltage VC. In the embodiment, all switches are carried out by, for example, P-channel transistors.

The OLED 110 has the first terminal 1110 and the second terminal 1120. The OLED 110 is driven by a driving current ID to emit light. Specifically, when the driving current ID flows through the OLED 110, the OLED 110 is driven to emit light. Moreover, the luminous intensity of the OLED positively relates to the driving current ID very much. Therefore, two OLEDs that are the same will have the same luminous intensity when being supplied with the same driving current.

The driving switch 1200 has the first terminal 1210, the second terminal 1220, and the control terminal 1230. The driving switch 1200 controls the driving current ID according to the voltage V1230 at the control terminal 1230. In practice, the driving switch 1200 is considered as, for example, a transistor switch, such that the driving current ID relates to the voltage difference between the control terminal 1230 of the driving switch 1200 and the first terminal 1210 of the driving switch 1200 and the threshold voltage VTH of the driving switch 1200 in view of the current equation related to a transistor.

The enabling switch 1300 has the first terminal 1310, the second terminal 1320, and the control terminal 1330. The voltage V1330 at the control terminal 1330 of the enabling switch 1300 is a high voltage VH during a first time period P1 in a duty cycle PW such that the enabling switch 1300 is turned off during the first time period P1. On the other hand, the voltage V1330 at the control terminal 1330 of the enabling switch 1300 is a low voltage VL during a second time period P2 in the duty cycle PW such that the enabling switch 1300 is turned on during the second time period P2. In view of FIG. 1, when the enabling switch 1300 is turned on, the driving current ID flows through the OLED 1100 to drive the OLED 1100 to emit light.

The compensation circuit 1400 has the first terminal 1401, the second terminal 1402, the third terminal 1403, the fourth terminal 1404, and the fifth terminal 1405. The first terminal 1401 of the compensation circuit 1400 receives the second reference voltage VDD, the second terminal 1402 of the compensation circuit 1400 electrically connects to the second terminal 1220 of the driving switch 1200, the third terminal 1403 of the compensation circuit 1400 electrically connects to the control terminal 1230 of the driving switch 1200, and the fourth terminal 1404 of the compensation circuit 1400 receives the compensation voltage VC.

In details, the compensation circuit 1400 includes, for example, a first switch 1410, a second switch 1420, a first capacitor 1430, and a second capacitor 1440. The capacitance value of the first capacitor 1430 is not larger than the quintuple of the capacitance value of the second capacitor 1440.

The first switch 1410 has the first terminal 1411, the second terminal 1412, and the control terminal 1413. The first terminal 1411 of the first switch 1410 electrically connects to the first terminal 1401 of the compensation circuit 1400, so as to receive the second reference voltage VDD. The second terminal 1412 of the first switch 1410 electrically connects to the third terminal 1403 of the compensation circuit 1400, so as to electrically connect to the control terminal 1230 of the driving switch 1200. The second switch 1420 has the first terminal 1421, the second terminal 1422, and the control terminal 1423. The first terminal 1421 of the second switch 1420 electrically connects to the second terminal 1402 of the compensation circuit 1400, so as to electrically connect to the second terminal 1220 of the driving switch 1200. The two terminals of the first capacitor 1430 electrically connect to the control terminal 1230 of the driving switch 1200 and the second terminal 1422 of the second switch 1420 respectively. One terminal of the second capacitor 1440 electrically connects to the second terminal 1422 of the second switch 1420, and the other one terminal of the second capacitor 1440 electrically connects to the fourth terminal 1404 of the compensation circuit 1400 to receive the compensation voltage VC.

The data switch 1500 has the first terminal 1510, the second terminal 1520, and the third terminal 1530. The first terminal 1510 of the data switch 1500 electrically connects to the fifth terminal 1405 of the compensation circuit 1400, so as to electrically connect to the second terminal 1422 of the second switch 1420. The second terminal 1520 of the data switch 1500 receives a data voltage VDATA. The voltage V1530 at the third terminal 1530 of the data switch 1500 is a low voltage VL during third time period P3 in the duty cycle PW, and thus, the data switch 1500 is turned on during the third time period P3.

The compensation voltage VC is at the first voltage level V1 during a fourth time period P4 in the duty cycle PW and is at the second voltage level V2 during the duty cycle PW except the fourth time period P4. The third time period P3 partially overlaps the fourth time period P4, the third time period P3 starts in the fourth time period P4, and the third time period P3 and the fourth time period P4 are in the first time period P1.

When the voltage V1413 at the control terminal 1413 of the first switch 1410 and the voltage V1423 at the control terminal 1423 of the second switch 1420 are at the low voltage VL during a fifth time period P5 in the first time period P1, the first switch 1410 and the second switch 1420 are turned on during the fifth time period P5. As shown in FIG. 2, the fifth time period P5 partially overlaps the fourth time period P4, and the starting point T51 of the fifth time period P5 is earlier than the starting point T41 of the fourth time period P4.

The operation of the pixel circuit 1000 in FIG. 1 is illustrated below in view of FIG. 2. From the starting point T51 of the fifth time period P5 to the starting point T41 of the fourth time period P4, since the first switch 1410 is turned on, the voltage V1230 at the control terminal 1230 of the driving switch 1200 is adjusted to equal the second reference voltage VDD. Then, at the starting point T41 of the fourth time period P4, the compensation voltage VC is changed from the second voltage level V2 to the first voltage level V1. In this embodiment, the first voltage level V1 is larger than the second voltage level V2. Therefore, the voltage at the second terminal 1422 of the second switch 1420 is pulled up to be greater than the second reference voltage VDD, and then the driving switch 1200 operates in the diode-connected state where the control terminal 1230 electrically connects to the first terminal 1210. Herein, before the end point T52 arrives in the fifth time period P5, the voltage at the second terminal 1422 of the second switch 1420 gradually drops to approximately equal the second reference voltage VDD plus the absolute value of the threshold voltage VTH of the driving switch 1200.

At the starting point T31 of the third time period P3, the data switch 1500 is turned on, such that the voltage at the second terminal 1422 of the second switch 1420 is rapidly pulled to equal the data voltage VDATA. Herein, because of capacitor coupling, the voltage V1230 at the control terminal 1230 of the driving switch 1200 is pulled to equal the data voltage VDATA minus the absolute value of the threshold voltage VTH of the driving switch 1200. Then, at the end point T42 of the fourth time period P4, the compensation voltage VC drops from the first voltage level V1 to the second voltage level V2, and the data switch 1500 is turned on. Therefore, the change of the compensation voltage VC will not affect the voltage at other nodes. When the third time period P3 ends, the data switch 1500 is turned off and the voltage V1230 at the control terminal 1230 of the driving switch 1200 equals the data voltage VDATA minus the absolute value of the threshold voltage VTH of the driving switch 1200. Therefore, when the first time period P1 ends, the second time period P2 starts, where the driving switch 1200 outputs the driving current ID which is set by the following equation (1):

$$ID=K[VDD-(VDATA-|VTH|)-|VTH|]^2=K(VDD-VDATA)^2 \quad (1)$$

where K is the characteristic coefficient of the driving switch 1200. In view of the equation (1), the driving current ID in the disclosure is not related to the threshold voltage VTH of the driving switch 1200.

Figure 3:
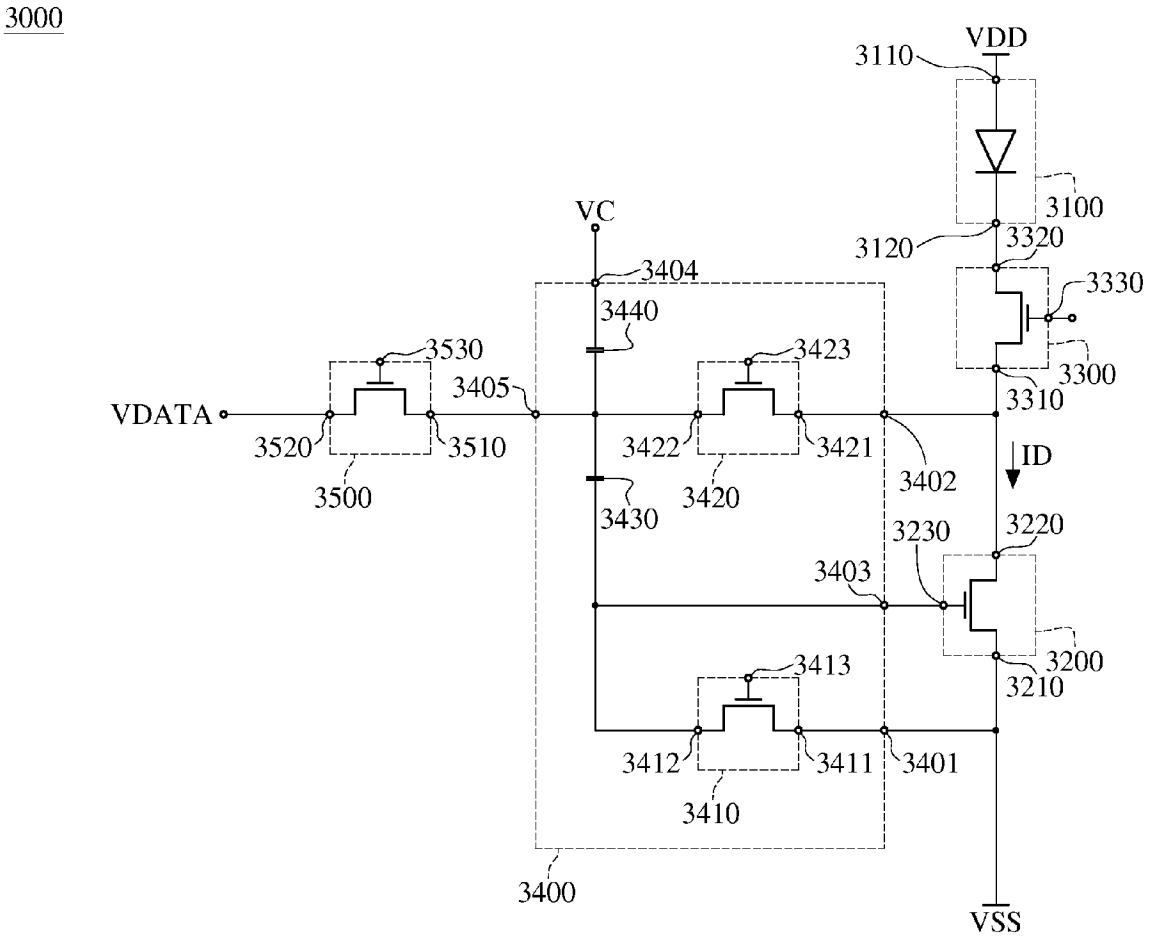
FIG. 3 is a schematic diagram of a pixel circuit with an organic light emitting diode according to other embodiment of the disclosure.

On the other hand, the P-channel switches in FIG. 1 can be replaced by N-channel transistors. The pixel circuit carried out by the N-channel transistors is shown in FIG. 3. FIG. 3 is a schematic diagram of a pixel circuit with an organic light emitting diode according to other embodiment of the disclosure. The pixel circuit 3000 includes, for example, an OLED 3100, a driving switch 3200, an enabling switch 3300, a compensation circuit 3400, and a data switch 3500. The first terminal 3110 of the OLED 3100 receives a reference voltage VDD. The first terminal 3210 of the driving switch 3200 receives a reference voltage VSS. The first terminal 3310 of the enabling switch 3300 electrically connects to the second terminal 3220 of the driving switch 3200, and the second terminal 3320 of the enabling switch 3300 electrically connects to the second terminal 3120 of the OLED 3100. The first terminal 3401 of the compensation circuit 3400 receives the reference voltage VSS, the second terminal 3402 of the compensation circuit 3400 electrically connects to the second terminal 3210 of the driving switch 3200, the third terminal 3403 of the compensation circuit 3400 electrically connects to the control terminal 3230 of the driving switch 3200, and the fourth terminal 3404 of the compensation circuit 3400 receives a compensation voltage VC.

The OLED 3100 has the first terminal 3110 and the second terminal 3120. The OLED 3100 is driven by a driving current ID to emit light. The driving switch 3200 has the first terminal 3210, the second terminal 3220, and the control terminal 3230. The driving switch 3200 controls the driving current ID according to the voltage at the control terminal 3230. In practice, the driving switch 3200 can be considered as, for example, a transistor switch. Therefore, the driving current ID relates to the voltage difference between the control terminal 3230 of the driving switch 3200 and the first terminal 3210 of the driving switch 3200 and the threshold voltage VTH of the driving switch 3200.

The enabling switch 3300 has the first terminal 3310, the second terminal 3320, and the control terminal 3330. Similar to the one or more embodiments related to FIG. 1, the enabling switch 3300 is turned off during the first time period P1 and is turned on during the second time period P2 in the duty cycle PW. In view of FIG. 3, when the enabling switch 3300 is turned on, the driving current ID flows through the OLED 3100 to drive the OLED 3100 to emit light.

The compensation circuit 3400 has the first terminal 3401, the second terminal 3402, the third terminal 3403, the fourth terminal 3404, and the fifth terminal 3405. The first terminal 3401 of the compensation circuit 3400 receives the reference voltage VSS, the second terminal 3402 of the compensation circuit 3400 electrically connects to the second terminal 3220 of the driving switch 3200, the third terminal 3403 of the compensation circuit 3400 electrically connects to the control terminal 3230 of the driving switch 3200, and the fourth terminal 3404 of the compensation circuit 3400 receives the compensation voltage VC.

Specifically, the compensation circuit 3400 includes, for example, a first switch 3410, a second switch 3420, a first capacitor 3430, and a second capacitor 3440. The capacitance value of the first capacitor 3430 is not larger than the quintuple of the capacitance value of the second capacitor 3440.

The first switch 3410 has the first terminal 3411, the second terminal 3412, and the control terminal 3413. The first terminal 3411 of the first switch 3410 electrically connects to the first terminal 3401 of the compensation circuit 3400, so as to receive the reference voltage VSS. The second terminal 3412 of the first switch 3410 electrically connects to the third terminal 3403 of the compensation circuit 3400, so as to electrically connect to the control terminal 3230 of the driving switch 3200. The second switch 3420 has the first terminal 3421, the second terminal 3422, and the control terminal 3423. The first terminal 3421 of the second switch 3420 electrically connects to the second terminal 3402 of the compensation circuit 3400, so as to electrically connect to the second terminal 3220 of the driving switch 3200. The two terminals of the first capacitor 3430 electrically connect to the control terminal 3230 of the driving switch 3200 and the second terminal 3422 of the second switch 3420 respectively. One terminal of the second capacitor 3440 electrically connects to the second terminal 3422 of the second switch 3420, and the other terminal of the second switch 3420 electrically connects to the fourth terminal 3404 of the compensation circuit 3400 to receive the compensation voltage VC.

The data switch 3500 has the first terminal 3510, the second terminal 3520, and the third terminal 3530. The first terminal 3510 of the data switch 3500 electrically connects to the fifth terminal 3405 of the compensation circuit 3400, so as to electrically connect the second terminal 3422 of the second switch 3420. The second terminal 3520 of the data switch 3500 receives a data voltage VDATA. The data switch 3500 is turned on during a third time period P3 in the duty cycle PW.

The compensation voltage VC is at the first voltage level V1 during the fourth time period P4 in the duty cycle PW and is at the second voltage level V2 during the duty cycle PW except the fourth time period P4. The third time period P3 partially overlaps the fourth time period P4, the third time period P3 starts in the fourth time period P4, and the third time period P3 and the fourth time period P4 are in the first time period P1.

The first switch 1410 and the second switch 1420 are turned on during the fifth time period P5. Similar to the one or more embodiments related to FIG. 1 and FIG. 2, the fifth time period P5 partially overlaps the fourth time period P4, and the starting point T51 of the fifth time period P5 is earlier than the starting point T41 of the fourth time period P4. The time period that each switch is turned on in this embodiment is the same as that in the embodiment in FIG. 1. However, the first voltage level V1 in this embodiment is smaller than the second voltage level V2. Therefore, before the fifth time period P5 ends, the voltage at the second terminal 3422 of the second switch 3420 can equal, for example, the reference voltage VSS minus the absolute value of the threshold voltage VTH of the driving switch 3200. Moreover, before the third time period P3 ends, the voltage at the control terminal 3230 of the driving switch 3200 is set by the compensation circuit 3400 to equal, for example, the data voltage VDATA plus the absolute value of the threshold voltage VTH of the driving switch 3200.

According to the above embodiments, the pixel circuit with an OLED in the disclosure allows that the on time of the data switch during which the data voltage is applied to the pixel circuit can be very short, and that the compensation time (i.e. the fourth time period and the fifth time period) is not limited by the on time of the data switch (i.e. the third time period). Furthermore, the pixel circuit in the disclosure can be carried out with only five transistor switches and two capacitors, and one of the two capacitors can have much smaller capacitance value than the other one. As a result, the pixel circuit in the disclosure can provide the OLED with more area in the limited space of the pixel circuit than a general pixel circuit carried out by six transistor switches and one capacitor.

What is claimed is:

1. A pixel circuit, comprising:

an organic light emitting diode (OLED) having a first terminal for receiving a first reference voltage, and a second terminal, the OLED being driven by a driving current;

a driving switch having a first terminal for receiving a second reference voltage, a second terminal, and a control terminal;

an enabling switch having a first terminal electrically connected to the second terminal of the driving switch, and a second terminal electrically connected to the second terminal of the OLED, for being turned off during a first time period in a duty cycle and being turned on during a second time period in the duty cycle;

a compensation circuit having a first terminal for receiving the second reference voltage, a second terminal electrically connected to the second terminal of the driving switch, a third terminal electrically connected to the control terminal of the driving switch, a fourth terminal for receiving a compensation voltage, and a fifth terminal; and a data switch having a first terminal electrically connected to the fifth terminal of the compensation circuit, and a second terminal for receiving a data voltage, the data switch being turned on during a third time period in the duty cycle;

wherein the compensation voltage is at a first voltage level during a fourth time period in the duty cycle and is at a second voltage level during the duty cycle except the fourth time period, the third time period partially overlaps the fourth time period, the third time period starts in the fourth time period, and the third time period and the fourth time period are in the first time period.

2. The pixel circuit according to claim 1, wherein the compensation circuit comprises:

a first switch having a first terminal for receiving the second reference voltage, and a second terminal electrically connected to the control terminal of the driving switch, the first switch being turned on during a fifth time period in the duty cycle;

a second switch having a first terminal electrically connected to the second terminal of the driving switch, and a second terminal, the second switch being turned on during the fifth time period;

a first capacitor whose two terminals electrically connected to the control terminal of the driving switch and the second terminal of the second switch respectively; and a second capacitor whose one terminal electrically connected to the second terminal of the second switch and whose the other terminal is for receiving the compensation voltage;

wherein the fifth time period partially overlaps the fourth time period, and the fifth time period starts before the fourth time period.

3. The pixel circuit according to claim 2, wherein a ratio of the first capacitor to the second capacitor is less than 5.

4. The pixel circuit according to claim 2, wherein the first and second switches are P-channel transistors, and the first voltage level is higher than the second voltage level.

5. The pixel circuit according to claim 4, wherein before the fifth time period ends, a voltage at the second terminal of the second switch equals the second reference voltage plus an absolute value of a threshold voltage of the driving switch.

6. The pixel circuit according to claim 4, wherein before the third time period ends, a voltage at the control terminal of the driving switch is set by the compensation circuit to equal a difference between the data voltage and an absolute value of a threshold voltage of the driving switch.

7. The pixel circuit according to claim 2, wherein the first and second switches are N-channel transistors, and the first voltage level is lower than the second voltage level.

8. The pixel circuit according to claim 7, wherein before the fifth time period ends, a voltage at the second terminal of the second switch is set to be the second reference voltage minus an absolute value of a threshold voltage of the driving switch.

9. The pixel circuit according to claim 7, wherein before the third time period ends, a voltage at the control terminal of the driving switch is set by the compensation circuit to equal the data voltage plus an absolute value of a threshold voltage of the driving switch.

10. The pixel circuit according to claim 2, wherein before the fourth time period starts, a voltage at the control terminal of the driving switch is set by the compensation circuit to be the second reference voltage.

11. The pixel circuit according to claim 1, wherein the first and second switches are P-channel transistors, and the first voltage level is higher than the second voltage level.

12. The pixel circuit according to claim 11, wherein before the fifth time period ends, a voltage at the second terminal of the second switch is set to equal the second reference voltage plus an absolute value of a threshold voltage of the driving switch.

13. The pixel circuit according to claim 11, wherein before the third time period ends, a voltage at the control terminal of the driving switch is set by the compensation circuit to be a difference between the data voltage and an absolute value of a threshold voltage of the driving switch.

14. The pixel circuit according to claim 1, wherein the first and second switches are N-channel transistors, and the first voltage level is lower than the second voltage level.

15. The pixel circuit according to claim 14, wherein before the fifth time period ends, a voltage at the second terminal of the second switch equals the second reference voltage minus an absolute value of a threshold voltage of the driving switch.

16. The pixel circuit according to claim 14, wherein before the third time period ends, a voltage at the control terminal of the driving switch is set by the compensation circuit to equal the data voltage plus an absolute value of a threshold voltage of the driving switch.

17. The pixel circuit according to claim 1, wherein before the fourth time period starts, a voltage at the control terminal of the driving switch is set to be the second reference voltage by the compensation circuit.

* * * * *